US012716592B2

(12) United States Patent
Kirkland et al.

(10) Patent No.: US 12,716,592 B2
(45) Date of Patent: Aug. 25, 2026

(54) COOLING SYSTEM ASSEMBLY FOR A COOKING APPLIANCE

(71) Applicant: Haier US Appliance Solutions, Inc., Wilmington, DE (US)

(72) Inventors: Dasney Kirkland, Shelbyville, KY (US); Marcelo Torrentes, Louisville, KY (US); Arun Murthy, Hosur (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 376 days.

(21) Appl. No.: 18/366,346

(22) Filed: Aug. 7, 2023

(65) Prior Publication Data

US 2025/0052428 A1 Feb. 13, 2025

(51) Int. Cl.
*F24C 15/00* (2006.01)

(52) U.S. Cl.
CPC ..... *F24C 15/006* (2013.01)

(58) Field of Classification Search
CPC ... F04D 29/4253; F04D 29/283; F24C 15/006
See application file for complete search history.

(56) References Cited

U.S. PATENT DOCUMENTS 3,474,225 A * 10/1969 Leedy ..... F24C 15/007 219/400
5,477,036 A * 12/1995 Jun ..... H05B 6/642 219/757
5,597,392 A * 1/1997 Hawkins ..... F24F 13/28 55/DIG. 35
6,098,613 A * 8/2000 Wiersma ..... F24C 15/2007 126/21 R
6,656,243 B2 * 12/2003 Hodge ..... B01D 46/10 55/DIG. 35
8,973,333 B2 * 3/2015 Sugihara ..... E04B 1/2403 52/712
D796,661 S * 9/2017 Oswald, Jr. ..... D23/388
10,495,320 B2 12/2019 Torrentes et al.
11,185,953 B2 11/2021 Zelocuatecatl
11,506,397 B2 11/2022 Johnson
11,852,347 B2 * 12/2023 Yun ..... F24C 15/102
D1,021,061 S * 4/2024 Skaf ..... D23/393
(Continued)

FOREIGN PATENT DOCUMENTS

CA 2807862 C 4/2017
EP 2846100 A1 * 3/2015 ..... F24C 15/2042

OTHER PUBLICATIONS

Whirlpool Range Repair "How to Replace the Cooling Fan" (Whirlpool Part # W10810687), published May 2, 2018, https://www.youtube.com/watch?v=yDuuR_w6yfk, accessed Aug. 7, 2023.

*Primary Examiner* — Jorge A Pereiro
(74) *Attorney, Agent, or Firm* — Dority & Manning, P.A.

(57) ABSTRACT

A cooling system for a cooking appliance includes an inlet duct including a duct top and a duct bottom and forming an air passage; a cooling fan at least partially accommodated within the inlet duct; a fan bracket removably coupled to the duct bottom and at least partially surrounding the cooling fan; an exhaust duct coupled to the duct top, the exhaust duct being provided above the cooling fan along the vertical direction and defining an outlet; and a catch basket provided within the outlet of the exhaust duct.

17 Claims, 7 Drawing Sheets

(56) References Cited

U.S. PATENT DOCUMENTS

| | | | | |
|---|---|---|---|---|
| 2008/0160903 | A1* | 7/2008 | Fontana | F24F 13/085 454/289 |
| 2013/0072104 | A1* | 3/2013 | Picco | F24F 13/085 454/289 |
| 2020/0025390 | A1* | 1/2020 | Lee | F24C 15/101 |
| 2020/0092958 | A1* | 3/2020 | Neal | F24C 15/006 |
| 2021/0231309 | A1* | 7/2021 | Jang | F24C 7/082 |
| 2021/0302028 | A1* | 9/2021 | Han | F24C 15/322 |
| 2021/0404668 | A1* | 12/2021 | Jang | F24C 15/006 |
| 2022/0003424 | A1 | 1/2022 | Hatchett | |
| 2022/0082266 | A1* | 3/2022 | Perugu | F24C 15/2014 |
| 2022/0146112 | A1* | 5/2022 | Johnson | F24C 15/322 |
| 2023/0014727 | A1* | 1/2023 | Perugu | F24C 15/2007 |

* cited by examiner

COOLING SYSTEM ASSEMBLY FOR A COOKING APPLIANCE

FIELD OF THE INVENTION

The present subject matter relates generally to cooking appliances, and more particularly to cooling systems for cooking appliances.

BACKGROUND OF THE INVENTION

Conventional residential and commercial oven appliances generally include a cabinet that includes a cooking chamber for receipt of food items for cooking. Multiple heating elements are positioned within the cooking chamber to provide heat to food items located therein. The heating elements can include, for example, radiant heating elements, such as a bake heating assembly positioned at a bottom of the cooking chamber and/or a separate broiler heating assembly positioned at a top of the cooking chamber. In addition, conventional oven appliances include a cooktop positioned on a top of the appliance that includes one or more heating elements, such as electric heaters, gas burners, or induction heating elements.

Conventional ovens also frequently include a control panel that includes a display, indicator lights, buttons for regulating oven operation, and/or one or more control knobs for regulating the heat output of various heating elements. Such control panels are often exposed to extreme heat from the heating elements that are mounted on the cooktop of the conventional oven. A cooling system including a cooling fan is typically included to provide cooling air to one or more components of the appliance, including the control panel. In some instances, the cooling fan is provided at or near a rear of the appliance and may include ducting allowing air to pass through the components thereof. Such ducts may present potential entrances for debris and/or water (e.g., splashed from cooking pots, etc.).

Accordingly, a cooling system for an oven appliance with improved features for preventing debris and/or water from contacting sensitive connections within the appliance would be desirable. In particular, a cooling system that catches debris and diverts water toward exit zones would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a cooling system for a cooking appliance is provided. The cooling system may include an inlet duct including a duct top and a duct bottom and forming an air passage; a cooling fan at least partially accommodated within the inlet duct; a fan bracket removably coupled to the duct bottom and at least partially surrounding the cooling fan; an exhaust duct coupled to the duct top, the exhaust duct being provided above the cooling fan along the vertical direction and defining an outlet; and a catch basket provided within the outlet of the exhaust duct.

In another exemplary aspect of the present disclosure, a cooking appliance is provided. The cooking appliance may include a cabinet forming a cooking cavity; a cooktop provided above the cooking cavity; a wire cover selectively coupled to a rear face of the cabinet; and a cooling system provided between the cooktop and the cooking cavity. The cooling system may include an inlet duct including a duct top and a duct bottom and forming an air passage; a cooling fan at least partially accommodated within the inlet duct; a fan bracket removably coupled to the duct bottom and at least partially surrounding the cooling fan; an exhaust duct coupled to the duct top, the exhaust duct being provided above the cooling fan along the vertical direction and defining an outlet; and a catch basket provided within the outlet of the exhaust duct.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
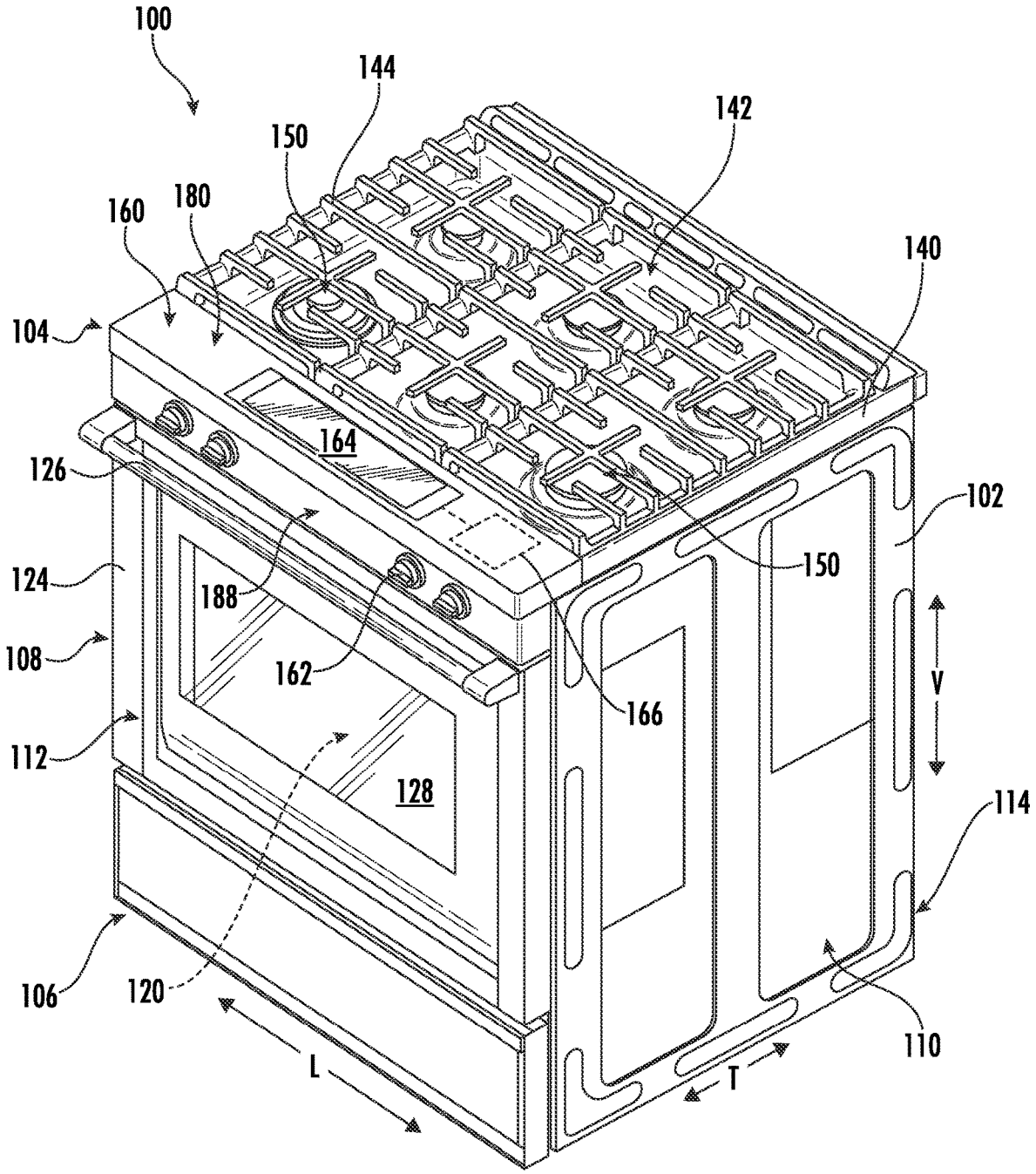
FIG. 1 provides a front perspective view of a cooking appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front, perspective view of an oven appliance 100 as may be employed with the present subject matter. Oven appliance 100 generally defines a vertical direction V, a lateral direction L, and a transverse direction T, each of which is mutually perpendicular, such that an orthogonal coordinate system is generally defined. As illustrated, oven appliance 100 includes an insulated cabinet 102. Cabinet 102 of oven appliance 100 extends between a top 104 and a bottom 106 along the vertical direction V, between a first side 108 (left side when viewed from front) and a second side 110 (right side when viewed from front) along the lateral direction L, and between a front 112 and a rear 114 along the transverse direction T.

Within cabinet 102 is a single cooking chamber 120 which is configured for the receipt of one or more food items to be cooked. However, it should be appreciated that oven appliance 100 is provided by way of example only, and aspects of the present subject matter may be used in any suitable cooking appliance, such as a double oven range appliance. Thus, the example embodiment shown in FIG. 1 is not intended to limit the present subject matter to any particular cooking chamber configuration or arrangement. Indeed, aspects of the present subject matter may be applied to display assemblies for any suitable appliance.

Oven appliance 100 includes a door 124 rotatably attached to cabinet 102 in order to permit selective access to cooking chamber 120. Handle 126 is mounted to door 124 to assist a user with opening and closing door 124 in order to access cooking chamber 120. As an example, a user can pull on handle 126 mounted to door 124 to open or close door 124 and access cooking chamber 120. One or more transparent viewing windows 128 (FIG. 1) may be defined within door 124 to provide for viewing the contents of cooking chamber 120 when door 124 is closed and also assist with insulating cooking chamber 120.

Figure 2:
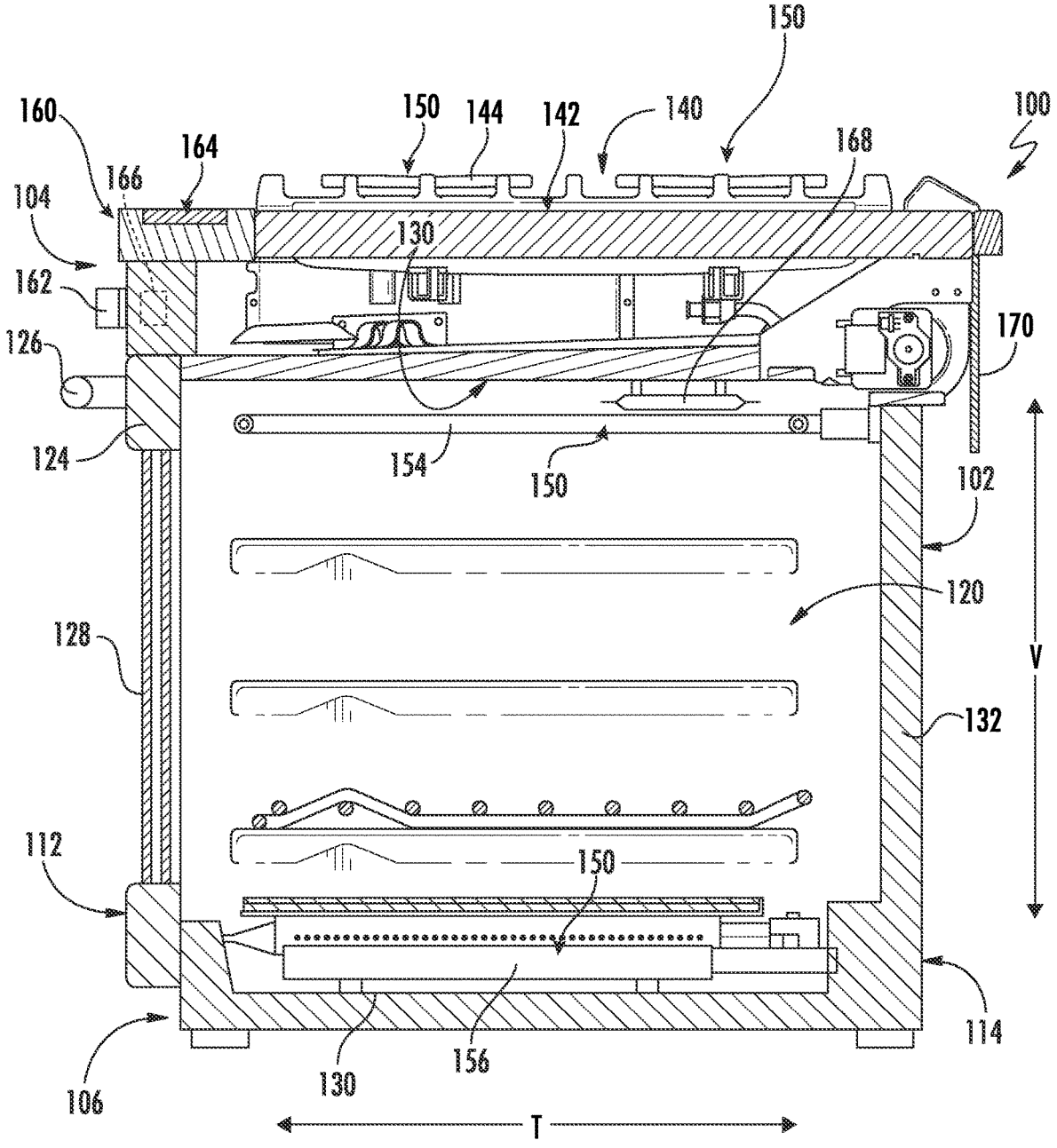
FIG. 2 provides a side cross-sectional view of the exemplary cooking appliance of FIG. 1 according to an exemplary embodiment of the present subject matter.

In general, cooking chamber 120 is defined by a plurality of chamber walls 130 (FIG. 2). Specifically, cooking chamber 120 may be defined by a top wall, a rear wall, a bottom wall, and two sidewalls. These chamber walls 130 may be joined together to define an opening through which a user may selectively access cooking chamber 120 by opening door 124. In order to insulate cooking chamber 120, oven appliance 100 includes an insulating gap defined between the chamber walls 130 and cabinet 102. According to an exemplary embodiment, the insulation gap is filled with an insulating material 132, such as insulating foam or fiberglass, for insulating cooking chamber 120.

Oven appliance 100 also includes a cooktop 140. Cooktop 140 is positioned at or adjacent top 104 of cabinet 102 such that it is positioned above cooking chamber 120. Specifically, cooktop 140 includes a top panel 142 positioned proximate top 104 of cabinet 102. By way of example, top panel 142 may be constructed of glass, ceramics, enameled steel, and combinations thereof. One or more grates 144 may be supported on a top surface of top panel 142 for supporting cooking utensils, such as pots or pans, during a cooking process.

Oven appliance 100 may further include one or more heating elements (identified generally by reference numeral 150) for selectively heating cooking utensils positioned on grates 144 or food items positioned within cooking chamber 120. For example, referring to FIG. 1, heating elements 150 may be gas burners 150. Specifically, a plurality of gas burners 150 are mounted within or on top of top panel 142 underneath grates 144 that supports cooking utensils over the gas burners 150 while gas burners 150 provide thermal energy to cooking utensils positioned thereon, e.g., to heat food and/or cooking liquids (e.g., oil, water, etc.). Gas burners 150 can be configured in various sizes so as to provide e.g., for the receipt of cooking utensils (i.e., pots, pans, etc.) of various sizes and configurations and to provide different heat inputs for such cooking utensils. According to alternative embodiments, oven appliance 100 may have other cooktop configurations or burner elements.

In addition, heating elements 150 may be positioned within or may otherwise be in thermal communication with cooking chamber 120 for regulating the temperature within cooking chamber 120. Specifically, an upper gas heating element 154 (also referred to as a broil heating element or gas burner) may be positioned in cabinet 102, e.g., at a top portion of cooking chamber 120, and a lower gas heating element 156 (also referred to as a bake heating element or gas burner) may be positioned at a bottom portion of cooking chamber 120. Upper gas heating element 154 and lower gas heating element 156 may be used independently or simultaneously to heat cooking chamber 120, perform a baking or broil operation, perform a cleaning cycle, etc. The size and heat output of gas heating elements 154, 156 can be selected based on the, e.g., the size of oven appliance 100 or the desired heat output. Oven appliance 100 may include any other suitable number, type, and configuration of heating elements 150 within cabinet 102 and/or on cooktop 140. For example, oven appliance 100 may further include electric heating elements, induction heating elements, or any other suitable heat generating device.

A control panel assembly 160 is located within convenient reach of a user of the oven appliance 100. For this example embodiment, control panel assembly 160 is positioned at a top 104 and front 112 of cabinet 102, e.g., above door 124 along the vertical direction V and forward of cooktop 140 along the transverse direction T. Control panel assembly 160 includes knobs 162 that are each associated with one of heating elements 150. In this manner, knobs 162 allow the user to activate each heating element 150 and determine the amount of heat input provided by each heating element 150 for cooking food items within cooking chamber 120 or on cooktop 140. Although shown with knobs 162, it should be understood that knobs 162 and the configuration of oven appliance 100 shown in FIG. 1 is provided by way of example only. More specifically, control panel assembly 160 may include various input components, such as one or more of a variety of touch-type controls, electrical, mechanical or electro-mechanical input devices including rotary dials, push buttons, and touch pads. Control panel assembly 160 may also be provided with one or more graphical display devices or display components, such as a digital or analog display device designed to provide operational feedback or other information to the user such as e.g., whether a particular heating element 150 is activated and/or the rate at which the heating element 150 is set. Indeed, according to the illustrated embodiment, control panel assembly 160 includes a display assembly 164, such as a liquid crystal display with an interactive display and interface.

Generally, oven appliance 100 may include a controller 166 in operative communication with control panel assembly 160. Control panel assembly 160 of oven appliance 100 may be in communication with controller 166 via, for example, one or more signal lines or shared communication busses, and signals generated in controller 166 operate oven appliance 100 in response to user input via user input devices, e.g., control knobs 162 and/or display assembly 164. Input/Output ("I/O") signals may be routed between controller 166 and various operational components of oven appliance 100 such that operation of oven appliance 100 can be regulated by controller 166. In addition, controller 166 may also be communication with one or more sensors, such as temperature sensor 168 (FIG. 2), which may be used to measure temperature inside cooking chamber 120 and provide such measurements to the controller 166. Although temperature sensor 168 is illustrated at a top and rear of cooking chamber 120, it should be appreciated that other sensor types, positions, and configurations may be used according to alternative embodiments.

Controller 166 is a "processing device" or "controller" and may be embodied as described herein. Controller 166 may include a memory and one or more microprocessors, microcontrollers, application-specific integrated circuits (ASICS), CPUs or the like, such as general or special purpose microprocessors operable to execute programming instructions or micro-control code associated with operation of oven appliance 100, and controller 166 is not restricted necessarily to a single element. The memory may represent random access memory such as DRAM, or read only memory such as ROM, electrically erasable, programmable read only memory (EEPROM), or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Although aspects of the present subject matter are described herein in the context of a single oven appliance, it should be appreciated that oven appliance 100 is provided by way of example only. Other oven or range appliances having different configurations, different appearances, and/or different features may also be utilized with the present subject matter, e.g., double ovens, standalone cooktops, etc.

Oven appliance 100 may include a wire cover 170. Wire cover 170 may be provided at the rear 114 of cabinet 102. For instance, wire cover 170 may be selectively coupled to a rear panel of cabinet 102 (e.g., by one or more removable fasteners). Accordingly, wire cover 170 may be selectively removed from cabinet 102 to allow access to components located at the rear 114 of cabinet 102. Wire cover 170 may define a predetermined height along the vertical direction V. The predetermined height of wire cover 170 may be between about 20% and about 50% of a total height of cabinet 102. Accordingly, wire cover 170 may cover between about 20% and about 50% of rear 114 of cabinet 102. Wire cover 170 may be positioned predominantly toward the top 104 of cabinet 102. Accordingly, wire cover 170 extends downward the predetermined height from top 104 of cabinet 102.

Figure 3:
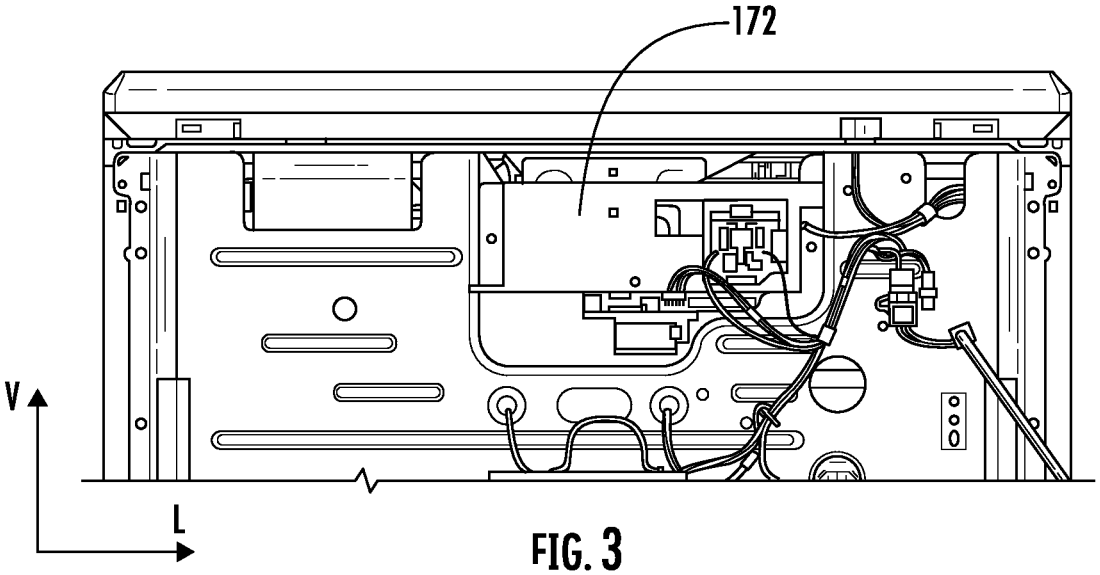
FIG. 3 provides a rear view of the exemplary cooking appliance of FIG. 1 with a wire cover removed.

FIG. 3 provides a close up view of the top rear of cabinet 102 with wire cover 170 removed. As shown in FIG. 3, once wire cover 170 is removed, access is provided to an interior of cabinet 102 (e.g., to one or more operational components of oven appliance 100). A fan bracket 172 may be provided (e.g., between wire cover 170 and cabinet 102). Fan bracket 172 may be selectively attached to cabinet 102 (e.g., via one or more fasteners). Fan bracket 172 may at least partially cover or surround a cooling fan (described below) provided within oven appliance 100. Accordingly, in order to service components within oven appliance 100, each of wire cover 170 and fan bracket 172 may be removed to provide easy access to, e.g., the cooling fan.

Figure 4:
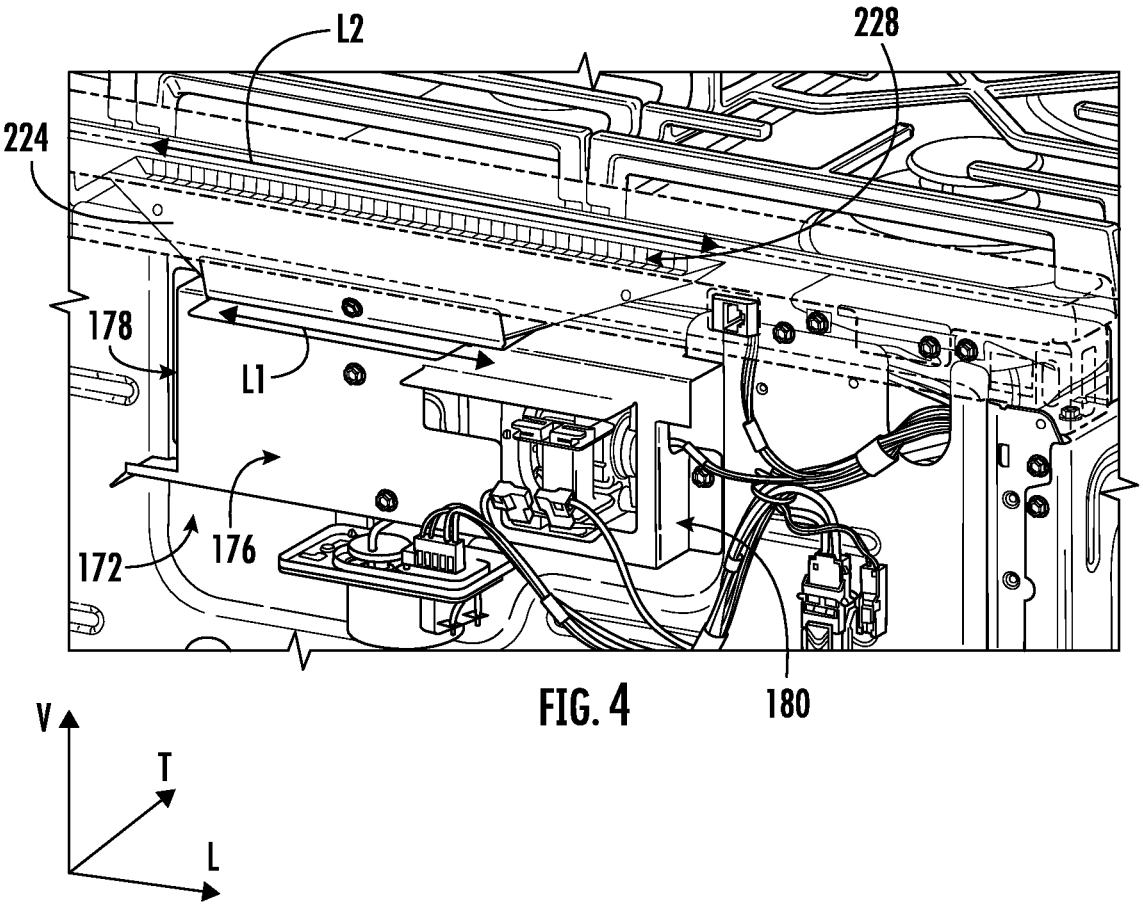
FIG. 4 provides a rear perspective view of the exemplary cooking appliance of FIG. 1 with a wire cover removed.
Figure 7:
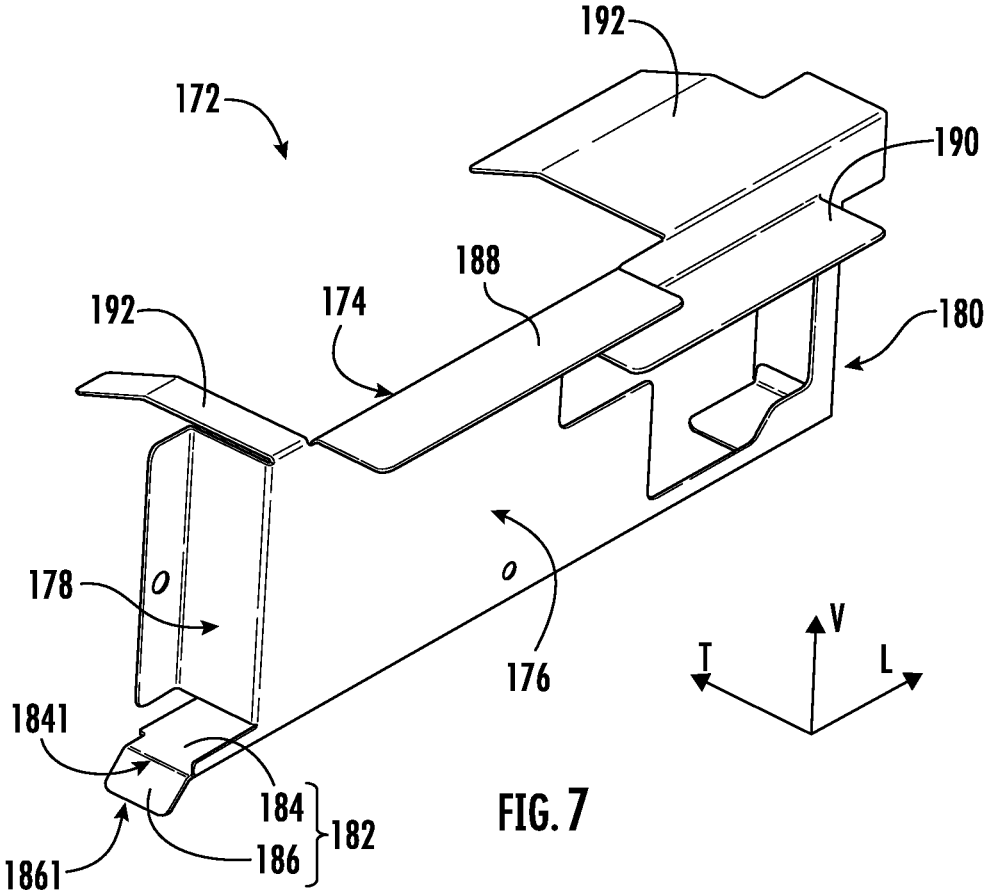
FIG. 7 provides a rear perspective view of a fan bracket according to exemplary aspects of the present disclosure.

Referring briefly to FIGS. 4 and 7, fan bracket 172 may define a motor face 174 and a cabinet face 176 opposite motor face 174. In detail, fan bracket 172 may be predominantly planar along the lateral direction L and the vertical direction V (e.g., predominantly parallel with wire cover 170). Motor face 174 may thus face the cooling fan and motor (described below) while cabinet face 176 faces wire cover 170. Fan bracket 172 may further define a first lateral end 178 and a second lateral end 180 opposite first lateral end 178. According to at least some embodiments, first lateral end 178 and second lateral end 180 are planar faces defined along the vertical direction V and the transverse direction T (e.g., predominantly parallel with cabinet face 176). For instance, first lateral end 178 and second lateral end 180 may extend along the transverse direction T toward oven appliance 102 (e.g., to define a pair of connection flanges).

Fan bracket 172 may include a fan spout 182. Fan spout 182 may extend from first lateral end 178 (e.g., along the lateral direction L) of fan bracket 172. Fan spout 182 may include a first portion 184 and a second portion 186. For instance, first portion 184 may be a lateral portion. First portion 184 may extend predominantly along the lateral direction L (e.g., from first end 178) away from fan bracket 172. First portion (or lateral portion) 184 may be defined along the lateral direction L and the transverse direction T. Accordingly, first portion 184 may be a tab protruding from fan bracket 172 along the lateral direction L.

Second portion (or angled portion) 186 of fan spout 182 may extend from first portion 184. In detail, second portion 186 may extend at a predetermined angle (e.g., between 0 degrees and 90 degrees) with respect to first portion 184. Second portion 186 may extend downward (e.g., along the vertical direction V) and laterally outward (e.g., along the lateral direction L) from a distal end 1841 of first portion 184. Accordingly, a distal end 1861 of second portion 186 may be provided lower (e.g., along the vertical direction V) than distal end 1841 of first portion 184. As such, debris or liquid may flow or move from first portion 184 toward second portion 186 and laterally outward from fan bracket 172.

Fan bracket 172 may include a first rear flange 188. First rear flange 188 may extend from cabinet face 176 along the transverse direction T. Additionally or alternatively, first rear flange 188 may extend along the lateral direction L. First rear flange 188 may be predominantly perpendicular to cabinet face 176. First rear flange 188 may extend a predetermined length along the lateral direction L. For instance, a lateral length of first rear flange 188 may be between about 45% and about 55% of a total length of fan bracket 172 along the lateral direction L. Additionally or alternatively, first rear flange 188 may protrude a predetermined depth from cabinet face 176 along the transverse direction T (e.g., rearward or away from oven appliance 100). The protruding depth of first rear flange 188 may be between about 3% and about 8% of the total length of fan bracket 172 along the lateral direction L. According to at least some embodiments, the protruding depth of first rear flange 188 along the transverse direction T is sufficient to catch liquid or debris while maintaining a gap (e.g., a tolerance gap) from wire cover 170 (e.g., when wire cover 170 is attached to cabinet 102).

Fan bracket 172 may include a second rear flange 190. Second rear flange 190 may extend from cabinet face 176 along the transverse direction T. Additionally or alternatively, second rear flange 190 may extend along the lateral direction L. Second rear flange 190 may be predominantly perpendicular to cabinet face 176. Second rear flange 190 may extend a predetermined length along the lateral direction L. For instance, a lateral length of second rear flange 190 may be between about 45% and about 55% of the total length of fan bracket 172 along the lateral direction L. Additionally or alternatively, second rear flange 190 may protrude a predetermined depth from cabinet face 176 along the transverse direction T (e.g., rearward or away from oven appliance 100). The protruding depth of second rear flange 190 may be between about 3% and about 8% of the total length of fan bracket 172 along the lateral direction L. According to at least some embodiments, the protruding depth of second rear flange 190 along the transverse direction T is sufficient to catch liquid or debris while maintaining a gap (e.g., a tolerance gap) from wire cover 170 (e.g., when wire cover 170 is attached to cabinet 102). Further still, second rear flange 190 may be offset from first rear flange 188. For instance, second rear flange 190 may be offset along the vertical direction V and the lateral direction L from first rear flange 188. According to some embodiments, a portion of first rear flange 188 overlaps a portion of second rear flange 190 along the vertical direction V (FIG. 4). Thus, second rear flange 190 may be positioned below first rear flange 188 along the vertical direction V.

Fan bracket may include a front flange 192. Front flange 192 may extend from motor face 174 (e.g., toward a front of oven appliance 100). Additionally or alternatively, front flange 192 may extend along the lateral direction L. Front flange 192 may be predominantly perpendicular to cabinet face 176. Moreover, front flange 192 may include a sloped portion sloping downward along the vertical direction V. Front flange 192 may extend a predetermined length along the lateral direction L. For instance, a lateral length of front flange 192 may be between about 35% and about 45% of the total length of fan bracket 172 along the lateral direction L. Additionally or alternatively, front flange 192 may protrude a predetermined depth from motor face 174 along the transverse direction T (e.g., forward or toward oven appliance 100). The protruding depth of front flange 192 may be between about 10% and about 15% of the total length of fan bracket 172 along the lateral direction L. Additionally or alternatively, front flange 192 may include a first portion provided adjacent to first lateral end 178 and a second portion provided adjacent to second lateral end 180.

Figure 5:
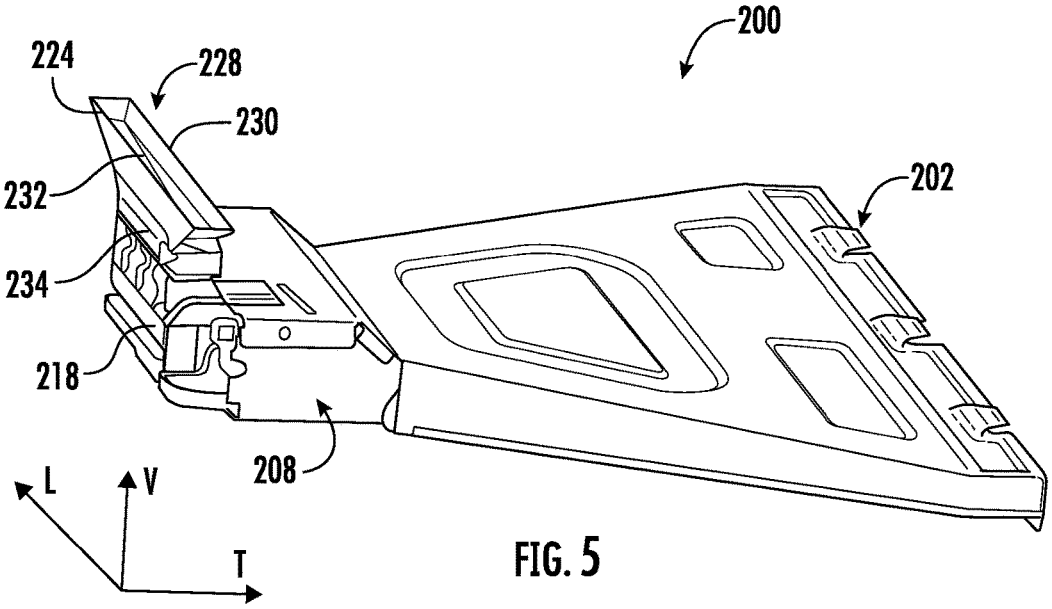
FIG. 5 provides a perspective view of a cooling system of the cooking appliance of FIG. 1 according to exemplary embodiments.
Figure 6:
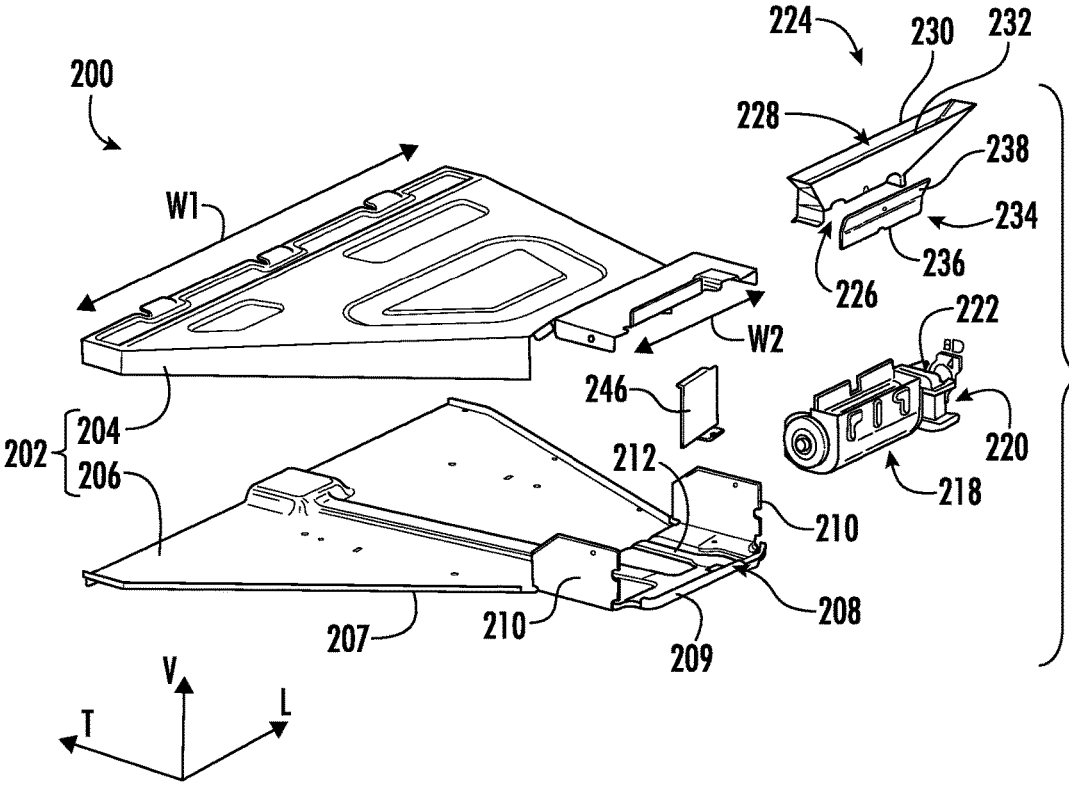
FIG. 6 provides an exploded perspective view of the exemplary cooling system of FIG. 5.

Referring now primarily to FIGS. 5 and 6, a cooling system 200 of oven appliance will be described in detail. According to some embodiments, cooling system includes fan bracket 172. However, fan bracket 172 is omitted from FIGS. 5 and 6 for clarity purposes. Cooling system 200 may include an inlet duct 202. Inlet duct 202 may be provided within cabinet 100. For instance, inlet duct 202 may be located between cooking chamber 120 and cooktop 140 (e.g., above cooking chamber 120 and beneath cooktop 140). Inlet duct 202 may thus extend from front 112 (e.g., adjacent control panel assembly 160) to rear 114 (e.g., adjacent wire cover 170) of cabinet 102. Inlet duct 202 may form an air passage therein, through which air is selectively motivated to provide a cooling effect to one or more components of oven appliance 100. According to at least some embodiments, inlet duct 202 includes an air inlet provided at a front thereof and an air outlet provided at a rear thereof.

Inlet duct 202 may include a duct top 204. Duct top 204 may form a top of inlet duct 202. Duct top 204 may include a main panel and a plurality of side panels. The main panel of duct top 204 may extend predominantly along the transverse direction T and the lateral direction L. Each of the plurality of side panels may extend downward predominantly along the vertical direction V from a periphery of the main panel. According to some embodiments, duct top 204 is formed from a single piece (e.g., of sheet metal) and the side panels are bent downward from the main panel.

Inlet duct 202 may include a duct bottom 206. Duct bottom 206 may extend predominantly along the transverse direction T and the lateral direction L. For instance, duct bottom 206 may be shaped similarly (or congruently) to duct top 204. The plurality of side panels of duct top 204 may thus selectively attach to duct bottom 206. Accordingly, the air passage may be formed between duct top 204 and duct bottom 206.

As shown in FIGS. 5 and 6, inlet duct 202 may define a first width W1 and a second width W2. First width W1 may be defined at an inlet thereof. For instance, first width W1 may be defined at the front of inlet duct 202 (e.g., proximate control panel assembly 160). Second width W2 may be defined at a rear of inlet duct 202 (e.g., proximate wire cover 170). First width W1 may be greater than second width W2. For instance, first width W1 may be between about two times and about three times the second width W2. Accordingly, the air passage formed within inlet duct 202 may taper from the inlet to the outlet.

Inlet duct 202 may define a fan housing 208. For instance, fan housing 208 may be defined at a rear of inlet duct 202. In detail, duct bottom 206 may include a pair of vertical flanges 210. The pair of vertical flanges may extend upward (e.g., along the vertical direction V) from duct bottom 206 toward duct top 204. Thus, the pair of vertical flanges 210 may be defined along the vertical direction V and the transverse direction T. Additionally or alternatively, a width of fan housing 208 may be the same as second width W2. Further still, fan housing 208 may define a depth (e.g., along the transverse direction T). The depth of fan housing 208 may be between about 8% and about 20% of a total depth of inlet duct 202 (e.g., along the transverse direction T).

For instance, duct bottom 206 may include a base panel 207 and a lip 209. Lip 209 may be provided at a periphery of base panel 207 (e.g., around an outer edge of base panel 207). Lip 209 may extend generally along the vertical direction V (e.g., toward duct top 204). An extension length of lip 209 may be between about 2% and about 5% of second length W2. Lip 209 may be provided at a rear of base panel 207. For instance, lip 209 is provided at a rear of fan housing 208. Lip 209 may extend predominantly between the pair of vertical flanges 210. Advantageously, liquid or debris within fan housing 208 may be restrained within fan housing 208 and restricted from collecting and falling toward components provided beneath cooling system 200.

Figure 11:
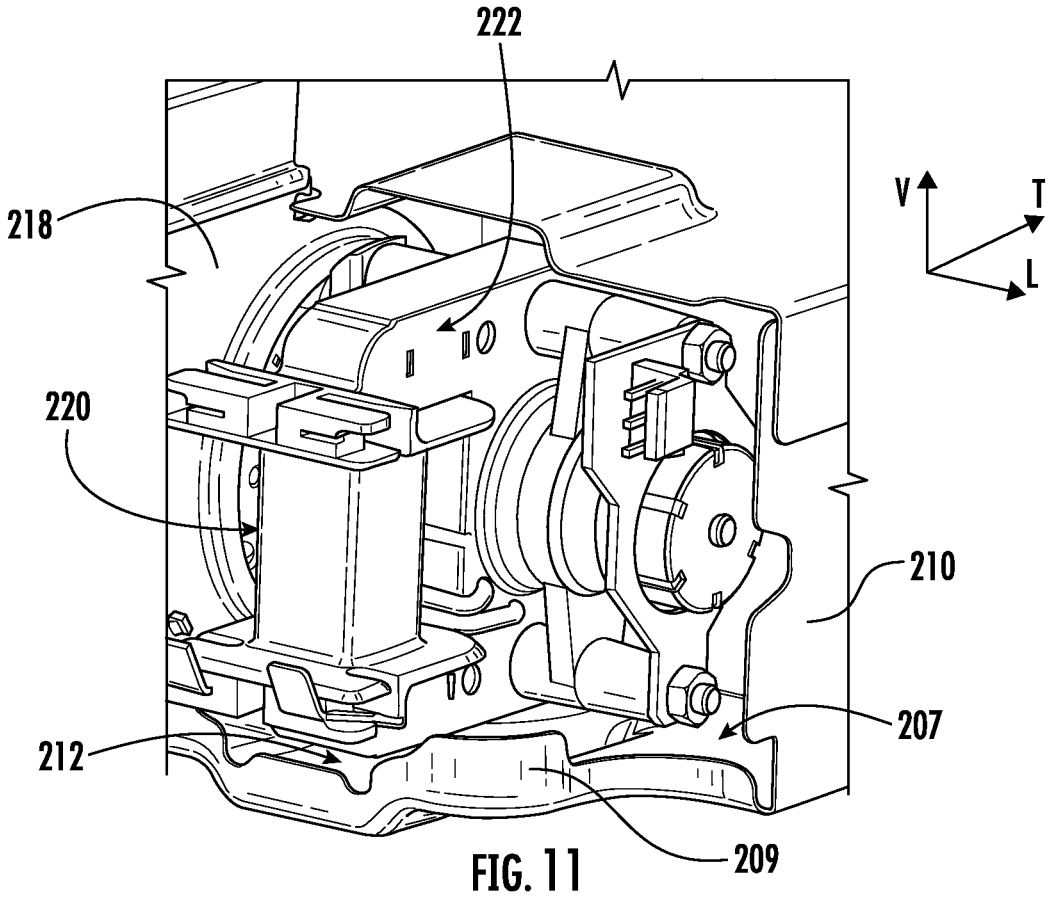
FIG. 11 provides a close-up view of the exemplary cooling system of FIG. 5 including a cooling fan and a duct bottom of an intake duct.
Figure 12:
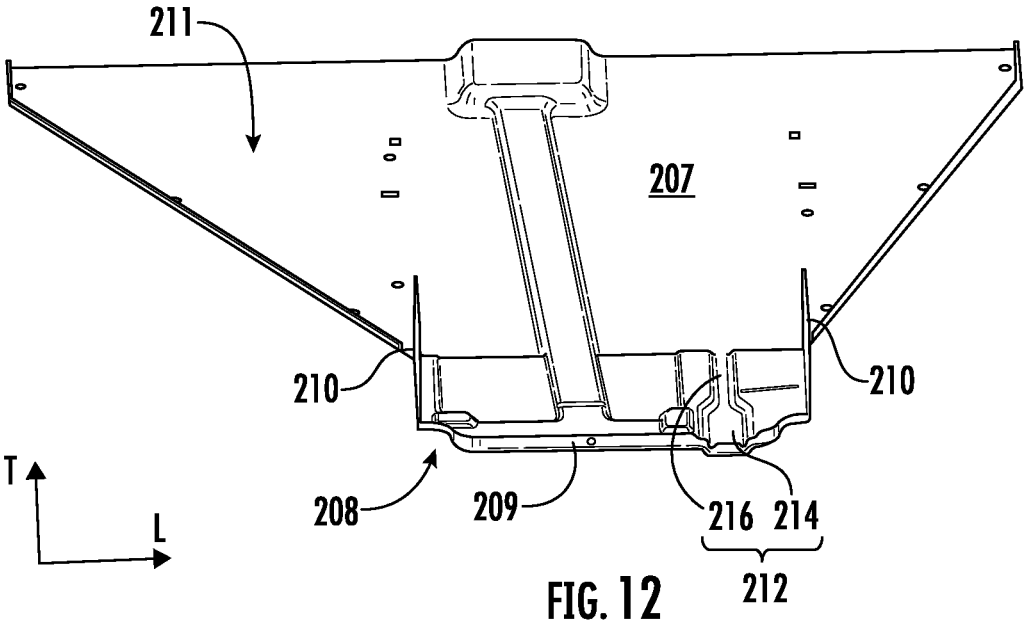
FIG. 12 provides a rear perspective view of a duct bottom of the exemplary cooling system of FIG. 5.

Base panel 207 may have a trough 212 formed therein. Referring to FIGS. 6, 11, and 12, trough 212 may be formed into a top face 211 of base panel 207 (e.g., downward along the vertical direction V). For instance, trough 212 may be provided within fan housing 208. Trough 212 may extend forward along the transverse direction T. As shown in FIG. 12, trough 212 may be a recessed portion of top face 211 within fan housing 208, extending from a rear of inlet duct 202 toward a front of inlet duct 202. Trough 212 may include a first portion 214 proximate the rear of inlet duct 202 (e.g., proximate lip 209) and a second portion 216 provided forward of first portion 214 (e.g., along the transverse direction T). First portion 214 may be wider than second portion 216 (e.g., along the lateral direction L). Additionally or alternatively, second portion 216 may be longer than first portion 214 (e.g., along the transverse direction T). Advantageously, debris and liquid may be funneled through trough 212 toward a front of inlet duct 202 and restricted from flowing out of the rear of inlet duct toward electrical connections provided beneath cooling system 200.

Cooling system 200 may include a cooling fan 218. For example, cooling fan 218 may urge a flow of air through inlet duct 202 and out of exhaust duct (described below) to an ambient environment. According to the illustrated exemplary embodiment, cooling fan 218 is a tangential fan positioned within inlet duct 202. However, it should be appreciated that according to alternative embodiments, cooling fan 218 may be positioned at any other suitable location and may be any other suitable fan type, such as a centrifugal fan, etc.

In addition, according to an exemplary embodiment, cooling fan 218 is a variable speed fan such that it may rotate at different rotational speeds, thereby generating different air flow rates. In this manner, the amount of air drawn over control panel assembly 160 may be continuously and precisely regulated. Moreover, by pulsing the operation of cooling fan 218 or throttling cooling fan 218 between different rotational speeds, the flow of air drawn into inlet duct 202 may have a different flow velocity or may generate a different flow pattern within inlet duct 202. Thus, by pulsating the variable speed fan or otherwise varying its speed, the flow of air may be randomized, thereby eliminating stagnant regions within inlet duct 202 and better circulating the flow of air to provide a more even cooling effect.

Cooling fan 218 may be positioned within fan housing 208 and may include a motor 220. As used herein, "motor" may refer to any suitable drive motor and/or transmission assembly for rotating cooling fan 218. For example, motor 220 may include a brushless DC electric motor, a stepper motor, or any other suitable type or configuration of motor. For example, motor 220 may include an AC motor, an induction motor, a permanent magnet synchronous motor, or any other suitable type of AC motor. Thus, motor 220 may include a stator 222. Specifically, stator 222 may be positioned above trough 212. In particular, with reference to FIG. 11, motor 220 may be positioned such that stator 222 is spaced apart from base plate 207 (e.g., via trough 212). According to some embodiments, stator 222 is positioned between about 0.3 inches and about 0.5 inches away from base plate 207 (e.g., via trough 212). Advantageously, a magnetic coupling may be reduced, thereby reducing operating noise of cooling fan 218.

Cooling system 200 may include an exhaust duct 224. Referring again chiefly to FIGS. 5 and 6, exhaust duct 224 may be provided above cooling fan 218 along the vertical direction V. Exhaust duct 224 may be selectively coupled to inlet duct 202. For instance, exhaust duct 224 may be coupled to duct top 204. Exhaust duct 224 may include an inlet 226 and an outlet 228. In at least some instances, air is urged through inlet duct 202 by cooling fan 218 and exhausted upward through exhaust duct 224. For instance, inlet 226 may be located at a bottom of exhaust duct 224 and in fluid communication with cooling fan 218 and inlet duct 202. Outlet 228 may be provided at a top of exhaust duct 224 and exposed to the ambient atmosphere.

Figure 10:
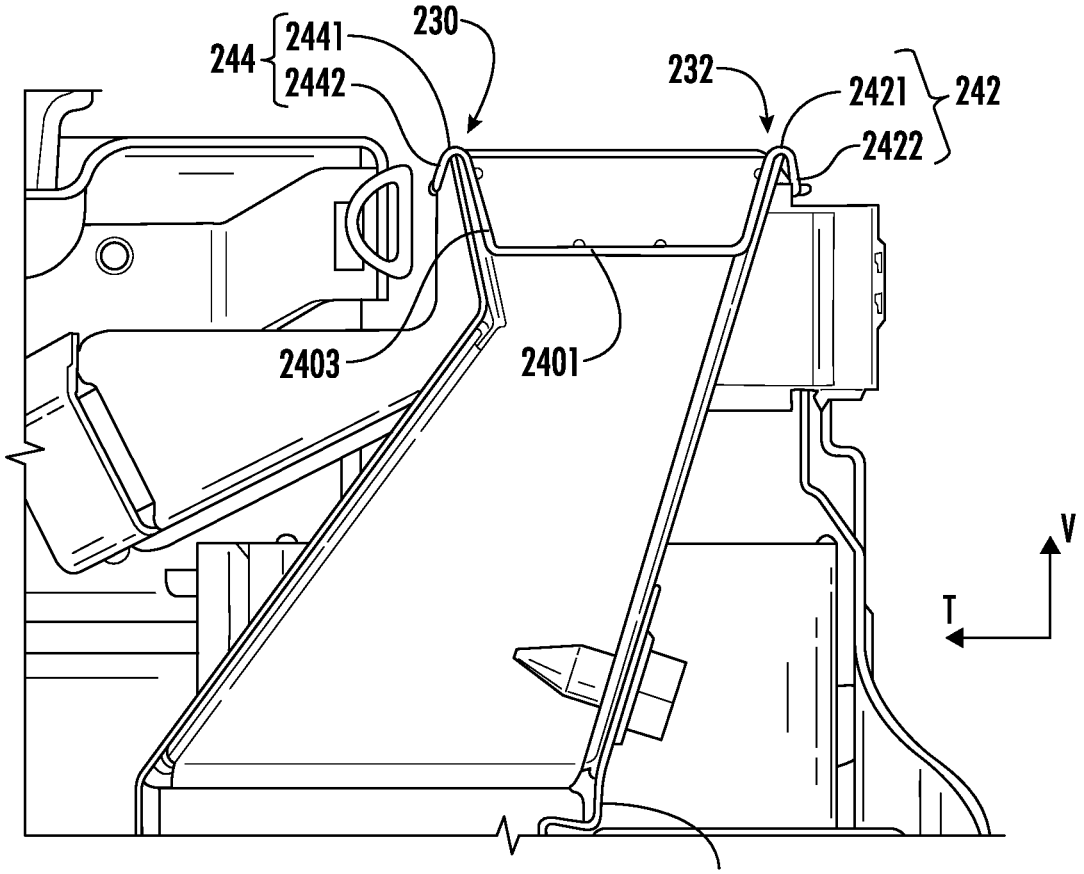
FIG. 10 provides a side section view of the cooling system of FIG. 5 including an exhaust duct and the exemplary catch basket of FIG. 8.

Referring briefly to FIG. 4, a lateral width L1 of inlet 226 may be less than a lateral width L2 of outlet 228. Accordingly, a cross-section of exhaust duct 224 may increase from inlet 226 to outlet 228 (e.g., along the vertical direction V). Additionally or alternatively, a depth of exhaust duct 224 (e.g., along the transverse direction T) may vary from inlet 226 to outlet 228 (e.g., along the vertical direction V). As shown in FIG. 10, for instance, the depth at inlet 226 may be larger than the depth at outlet 228. Additionally or alternatively, one or more choke points may be present within exhaust duct 224. For instance, the depth of exhaust duct 224 may be smallest or thinnest at a portion defined beneath outlet 228 (FIG. 10).

Exhaust duct 224 may be attached to duct top 204 (e.g., via one or more fasteners). In some instances, cooling fan 218 includes a connection flange extending along the vertical direction V. The connection flange may be coupled to duct top 204 together with exhaust duct 224. For example, one or more fasteners may penetrate each of exhaust duct 224, the connection flange of cooling fan 218, and duct top 204. In at least some embodiments, the connection flange of cooling fan 218 is positioned behind (e.g., along the transverse direction T) each of exhaust duct 224 and duct top 204. Additionally or alternatively, exhaust duct 224 may be positioned both behind (e.g., along the transverse direction T) and above (e.g., along the vertical direction V) inlet duct 202 (as shown in FIG. 5).

Figure 9:
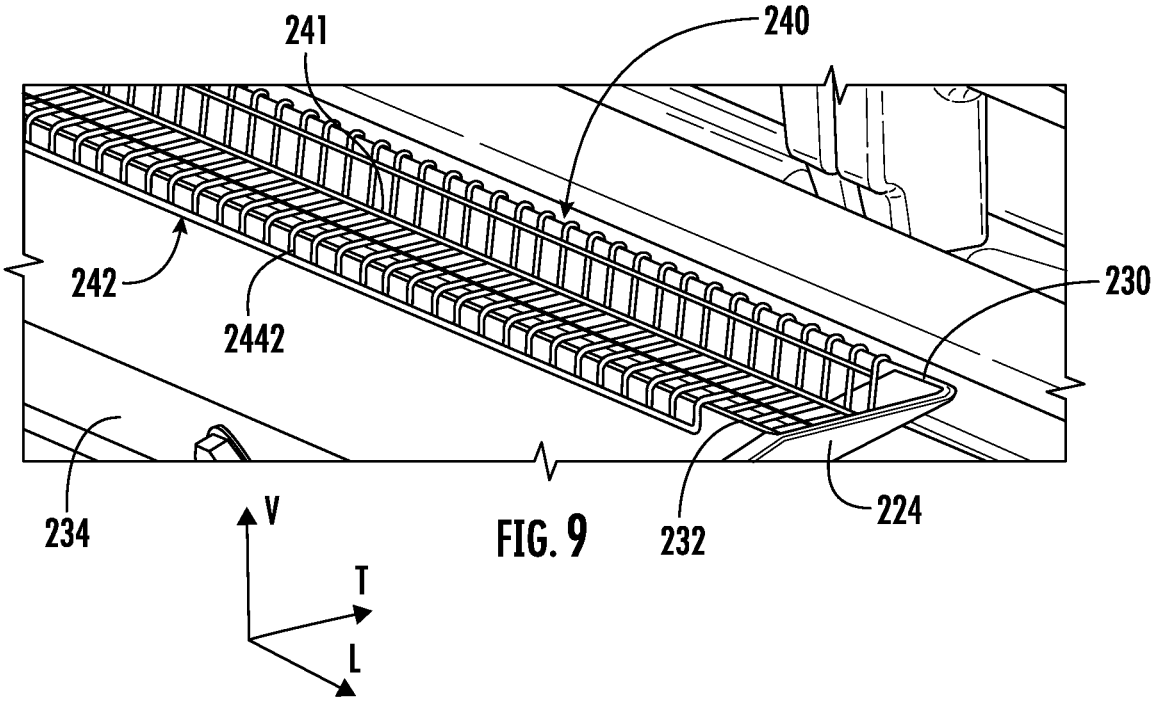
FIG. 9 provides a rear perspective view of the exemplary catch basket of FIG. 8 in an installed position.

Outlet 228 of exhaust duct 224 may include a front edge 230 and a rear edge 232. As best seen in FIG. 9, each of front edge 230 and rear edge 232 may extend along the lateral direction L. In some instances, front edge 230 and rear edge 232 are parallel with each other. Accordingly, front edge 230 and rear edge 232 may define an upper terminus of exhaust duct 224 (e.g., at front and rear portions thereof).

Cooling system 200 may include an exhaust duct extension 234. Exhaust duct extension 234 may be selectively attached to exhaust duct 224 (e.g., via one or more fasteners). For instance, exhaust duct extension 234 may be positioned between fan bracket 172 and inlet duct 202 (e.g., duct top 204). Exhaust duct extension 234 may include a pair of flanges. In detail, the pair of flanges includes a first flange 236 and a second flange 238. First flange 236 may be positioned between fan bracket 172 and exhaust duct 224. First flange 236 may be provided predominantly within a plane defined by the vertical direction V and the lateral direction L. Second flange 238 may extend from a top end of first flange 236. Second flange 238 may extend at an angle with respect to first flange 236 (e.g., an angle greater than 0 degrees and less than 90 degrees). Thus, second flange 238 may protrude along each of the vertical direction V and the transverse direction T (e.g., rearward toward wire cover 170 or away from oven appliance 100). Advantageously, exhaust duct extension 234 may prevent debris or liquid from contacting electrical elements provided beneath cooling system 200. Additionally or alternatively, exhaust duct extension 234 may be easily removed to allow service of one or more components within cooling system 200 (e.g., cooling fan 218) without having to disassemble additional elements such as cooktop 142.

Figure 8:
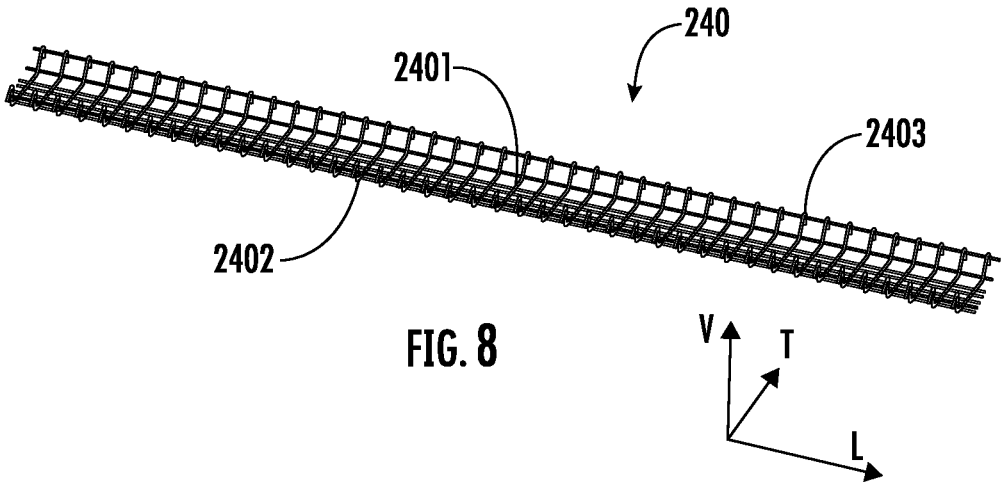
FIG. 8 provides a perspective view of a catch basket according to exemplary aspects of the present disclosure.

Cooling system 200 may include a catch basket 240. Catch basket 240 may be selectively received within exhaust duct 224. For instance, catch basket 240 may be received within outlet 228 of exhaust duct 224. Catch basket 240 may be a wire form, for instance, including a plurality of tines provided in a grid pattern. As shown in FIG. 8, catch basket 240 may extend along the lateral direction to substantially the lateral width L1 so as to fill outlet 228. Additionally or alternatively, catch basket 240 may define a plurality of through holes (e.g., as formed by the plurality of tines) through which air, liquid, and small debris may pass.

Catch basket 240 may include a base portion 2401 and a pair of sidewalls. Base portion 2401 may be defined along the lateral direction L and the transverse direction T. For instance, base portion 2401 may form a bottom or floor of catch basket 240 (e.g., within exhaust duct 224). The pair of sidewalls may extend from base portion 2401 predominantly along the vertical direction V. For example, a first sidewall 2402 is provided at a rear of catch basket 240 (e.g., along the transverse direction T) while a second sidewall 2403 is provided at a front of catch basket 240. Accordingly, as shown in FIG. 10, base portion 2401 may be positioned within exhaust duct 224, offset from front edge 230 and rear edge 232 downward (e.g., along the vertical direction V). According to some embodiments, the pair of sidewalls 2402 and 2403 may extend at a predetermined angle with respect to the vertical direction V. For instance, as shown in FIG. 10, rear sidewall 2402 extends along the vertical direction V and the transverse direction T (e.g., rearward) while front sidewall 2403 extends along the vertical direction V and the transverse direction T (e.g., frontward). Accordingly, catch basket 240 may fit within exhaust duct 224 (e.g., with sidewalls 2402 and 2403 being flush against an inner surface of exhaust duct 224).

Referring to FIGS. 9 and 10, catch basket 240 may include a first brim 242 and a second brim 244. First brim 242 may be provided along a first edge of catch basket 240 (e.g., at a top of the rear sidewall 2402). For instance, first brim 242 may be provided along a rear edge of catch basket 240 (e.g., rear sidewall 2402). First brim 242 may extend along the lateral direction L (e.g., across an entire lateral length of catch basket 240).

First brim 242 may include a curved portion 2421 and a planar portion 2422. Curved portion 2421 may extend from a top of rear sidewall 2402 along a curved path concave downward along the vertical direction V. For instance, as shown in FIG. 10, curved portion 2421 may curve over rear edge 232 such that a distal end thereof is positioned outward of exhaust duct 242. Planar portion 2422 may thus extend from the distal end of curved portion 2421. For instance, planar portion 2422 extends along the vertical direction V (e.g., predominantly downward) and along the transverse direction T (e.g., predominantly rearward).

Second brim 244 may include a curved portion 2441 and a planar portion 2442. Curved portion 2441 may extend from a top of front sidewall 2401 along a curved path concave downward along the vertical direction V. For instance, as shown in FIG. 10, curved portion 2441 may curve over front edge 234 such that a distal end thereof is positioned outward of exhaust duct 242. Planar portion 2442 may thus extend from the distal end of curved portion 2441. For instance, planar portion 2442 extends along the vertical direction V (e.g., predominantly downward) and along the transverse direction T (e.g., predominantly frontward). Advantageously, catch basket 240 may be suspended within exhaust duct 224 without the need for additional fasteners to catch large debris and prevent debris from entering cooling fan 218.

Cooling system 200 may include a duct diverter 246. Duct diverter 246 may be positioned within fan housing 208. For instance, duct diverter 246 may be a planar piece provided adjacent to cooling fan 218 to divert recirculated air into or away from cooling fan 218. Accordingly, duct diverter 246 may extend (e.g., along the vertical direction V) from base panel 207 to duct top 204. Additionally or alternatively, duct diverter 246 may be positioned in front of (e.g., along the transverse direction T) motor 220. Moreover, duct diverter may contact one of the pair of vertical flanges 210.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooling system for a cooking appliance, the cooling system defining a vertical direction, a lateral direction, and a transverse direction, the cooling system comprising:
   an inlet duct comprising a duct top and a duct bottom and forming an air passage;
   a cooling fan at least partially accommodated within the inlet duct;
   a fan bracket removably coupled to the duct bottom and at least partially surrounding the cooling fan, the fan bracket comprising a fan spout extending from a first lateral end of the fan bracket, the fan spout comprising a lateral portion and an angled portion extending from the lateral portion along the lateral direction and the vertical direction;
   an exhaust duct coupled to the duct top, the exhaust duct being provided above the cooling fan along the vertical direction and defining an outlet; and
   a catch basket provided within the outlet of the exhaust duct.

2. The cooling system of claim 1, further comprising:
   an exhaust duct extension removably coupled to the exhaust duct and extending downward along the vertical direction from the exhaust duct, wherein the exhaust duct extension comprises a flange provided between the fan bracket and the duct top along the transverse direction.

3. The cooling system of claim 1, wherein the duct bottom comprises:
   a base panel comprising a top face and a bottom face; and
   a lip provided at a periphery of the base panel, the lip extending upward along the vertical direction.

4. The cooling system of claim 3, wherein the base panel defines a trough formed into the top face thereof, the trough extending forward along the transverse direction.

5. The cooling system of claim 1, wherein the duct bottom is positioned between 0.3 inches and 0.5 inches beneath a bottom of the cooling fan along the vertical direction.

6. The cooling system of claim 1, wherein the catch basket comprises:
   a first brim provided along a rear edge thereof and extending along the lateral direction; and
   a second brim provided along a front edge thereof and extending along the lateral direction parallel with the first brim.

7. The cooling system of claim 6, wherein the first brim is configured to overhang a front edge of the exhaust duct and the second brim is configured to overhang a rear edge of the exhaust duct such that the catch basket is suspended over the outlet of the exhaust duct.

8. The cooling system of claim 1, wherein the fan bracket defines a motor face and a cabinet face opposite the motor face, the fan bracket comprising:
   a first rear flange extending from the cabinet face rearward along the transverse direction;
   a second rear flange extending from the cabinet face rearward along the transverse direction, the second rear flange being offset from the first rear flange along the vertical direction and the lateral direction; and
   a front flange extending from the motor face frontward along the transverse direction.

9. A cooking appliance defining a vertical direction, a lateral direction, and a transverse direction, the cooking appliance comprising:
   a cabinet forming a cooking cavity;
   a cooktop provided above the cooking cavity;
   a wire cover selectively coupled to a rear face of the cabinet; and
   a cooling system provided between the cooktop and the cooking cavity, the cooling system comprising:
      an inlet duct comprising a duct top and a duct bottom and forming an air passage;
      a cooling fan at least partially accommodated within the inlet duct;
      a fan bracket removably coupled to the duct bottom and at least partially surrounding the cooling fan, the fan bracket defining a motor face and a cabinet face opposite the motor face, the fan bracket comprising:
         a first rear flange extending from the cabinet face rearward along the transverse direction;
         a second rear flange extending from the cabinet face rearward along the transverse direction, the second rear flange being offset from the first rear flange along the vertical direction and the lateral direction; and
         a front flange extending from the motor face frontward along the transverse direction;
      an exhaust duct coupled to the duct top, the exhaust duct being provided above the cooling fan along the vertical direction and defining an outlet; and
      a catch basket provided within the outlet of the exhaust duct.

10. The cooking appliance of claim 9, wherein the cooling system further comprises:
   an exhaust duct extension removably coupled to the exhaust duct and extending downward along the vertical direction from the exhaust duct, wherein the exhaust duct extension comprises a flange provided between the fan bracket and the duct top along the transverse direction.

11. The cooking appliance of claim 9, wherein the duct bottom comprises:
   a base panel comprising a top face and a bottom face; and
   a lip provided at a periphery of the base panel, the lip extending upward along the vertical direction.

12. The cooking appliance of claim 11, wherein the base panel defines a trough formed into the top face thereof, the trough extending forward along the transverse direction.

13. The cooking appliance of claim 9, wherein the duct bottom is positioned between 0.3 inches and 0.5 inches beneath a bottom of the cooling fan along the vertical direction.

14. The cooking appliance of claim 9, wherein the catch basket comprises:
   a first brim provided along a rear edge thereof and extending along the lateral direction; and
   a second brim provided along a front edge thereof and extending along the lateral direction parallel with the first brim.

15. The cooking appliance of claim 14, wherein the first brim is configured to overhang a front edge of the exhaust duct and the second brim is configured to overhang a rear edge of the exhaust duct such that the catch basket is suspended over the outlet of the exhaust duct.

16. The cooking appliance of claim 9, wherein the fan bracket comprises:
   a fan spout extending from a first lateral end of the fan bracket, the fan spout comprising a lateral portion and an angled portion extending from the lateral portion along the lateral direction and the vertical direction.

17. A cooking appliance defining a vertical direction, a lateral direction, and a transverse direction, the cooking appliance comprising:

a cabinet forming a cooking cavity;

a cooktop provided above the cooking cavity;

a wire cover selectively coupled to a rear face of the cabinet; and a cooling system provided between the cooktop and the cooking cavity, the cooling system comprising:

an inlet duct comprising a duct top and a duct bottom and forming an air passage;

a cooling fan at least partially accommodated within the inlet duct;

a fan bracket removably coupled to the duct bottom and at least partially surrounding the cooling fan, the fan bracket comprising a fan spout extending from a first lateral end of the fan bracket, the fan spout comprising a lateral portion and an angled portion extending from the lateral portion along the lateral direction and the vertical direction;

an exhaust duct coupled to the duct top, the exhaust duct being provided above the cooling fan along the vertical direction and defining an outlet; and a catch basket provided within the outlet of the exhaust duct.

* * * * *